United States Patent [19]

Dall'Osso

[11] Patent Number: 4,693,374

[45] Date of Patent: Sep. 15, 1987

[54] DEVICE FOR FEEDING CIGARETTES TO THE WRAPPING LINE OF A PACKETING MACHINE

[75] Inventor: Gastone Dall'Osso, Bologna, Italy

[73] Assignee: G.D. Societa per Azioni, Bologna, Italy

[21] Appl. No.: 801,145

[22] Filed: Nov. 22, 1985

[30] Foreign Application Priority Data

Dec. 6, 1984 [IT] Italy ..... 3648 A/84

[51] Int. Cl.[4] ..... B07C 5/344

[52] U.S. Cl. ..... 209/535; 53/54; 131/907; 209/688

[58] Field of Search ..... 209/535–537, 209/688; 131/282, 283, 907, 908; 53/54, 148, 498, 500; 221/134, 216, 213, 224

[56] References Cited

U.S. PATENT DOCUMENTS

| | | | |
|---|---|---|---|
| 3,874,227 | 4/1975 | Focke | 209/535 |
| 4,093,075 | 6/1978 | Molins | 209/535 |
| 4,363,332 | 12/1982 | Preston et al. | 209/535 |
| 4,376,484 | 3/1983 | Serognoli | 209/535 |
| 4,445,520 | 5/1984 | Knight et al. | 209/535 |
| 4,592,470 | 6/1986 | Mattei et al. | 209/535 |
| 4,612,803 | 9/1986 | Manservisi et al. | 209/935 |

FOREIGN PATENT DOCUMENTS

| | | | |
|---|---|---|---|
| 0166088 | 1/1986 | European Pat. Off. . | |
| 1134468 | 4/1957 | France | 209/688 |
| 1298785 | 12/1972 | United Kingdom . | |

*Primary Examiner*—Robert B. Reeves
*Assistant Examiner*—Donald T. Hajec

[57] ABSTRACT

The device is of the type comprising a hopper (1), the lower portion of which contains the cigarettes (2) disposed in piles which are mobile stepwise along respective outlet channels (5) of the hopper (1), sensor (13) for checking the individual cigarettes (2) in the channels (5) at each advancement step of the cigarettes (2), a pusher element (8) arranged to remove the cigarettes (2) from the hopper (1), and at least one discarding device (40) for defective cigarettes (2), controlled by the sensor in the direction of advancement of the cigarettes (2); the discarding device (40) being provided with an engaging, retaining and extracting device (41) the defective cigarettes (2) and, at least during each extraction of a defective cigarette (2), being driven in phase with the pusher element (8).

16 Claims, 6 Drawing Figures

DEVICE FOR FEEDING CIGARETTES TO THE WRAPPING LINE OF A PACKETING MACHINE

The invention relates to a device for feeding cigarettes to the wrapping line of a packeting machine.

BACKGROUND OF THE PRIOR ART

In the known art, cigarettes usually enter a packaging machine by way of a hopper, to which the cigarettes are fed by suitable containers or by means of a belt conveyor which conveys them in the form of a continuous layer. At the outlet of this hopper, the cigarettes are combined into groups each consisting of a number of cigarettes equal to the number in the finished packet. The characteristics of the cigarettes of each group are then checked, and those groups which comprise even only one defective cigarette are discarded.

In order to reduce the number of expelled groups of cigarettes, and thus attain considerable cost saving, a device has been proposed by the present applicant G.S. S.p.A. in U.S. Pat. No. 4,376,484, which is able to check the regularity of the cigarettes while they are still in the hopper, and to discard them before they reach the grouping station. In this device, the cigarettes are expelled from the hopper preferably by means of a pneumatic expulsion device, which directs an axial stream of compressed air against the cigarettes found to be defective, causing them to emerge through suitable apertures provided in the hopper itself. Such a device is however not free from drawbacks, it having been found that the stream of compressed air which causes the defective cigarettes to emerge generates a vortex such that at least one defect-free cigarette also emerges together with the defective cigarette.

The object of the present invention is therefore to provide a device of the aforesaid type in which the stated problems are completely nullified.

Said object is attained according to the present invention by a device for feeding cigarettes to the wrapping line of a packaging machine, comprising a hopper for feeding cigarettes to said machine, said hopper being divided lowerly into outlet channels having a width substantially equal to the diameter of a cigarette, and through which the cigarettes disposed in piles descend stepwise until they rest on a horizontal wall from which they are removed by a horizontal pusher element driven with reciprocating motion; along each of said channels there being provided, from the top downwards, sensor means for checking the cigarettes in succession, and at least one discarding device controlled by said sensor means for removing the defective cigarettes from said hopper; said device being characterised in that said discarding device is a defective cigarette extraction device disposed, with respect to said hopper, between said sensor means and said pusher element and provided, for each of said channels, with means which engage, retain and extract the defective cigarettes from said hopper and which at least during their active travel in which they extract defective cigarettes are mobile parallel to the axis of said cigarettes between two end positions spaced-apart by a distance which is equal to or greater than the length of the stroke of said pusher element; one of said end positions being within said hopper; said engagement, retention and extraction means being mobile in determined phase relationship with said pusher element.

BRIEF DESCRIPTION OF THE DRAWINGS

Some preferred embodiments of the present invention are described hereinafter with reference to the accompanying drawings in which.

DETAILED DESCRIPTION OF THE INVENTION

Figure 1:
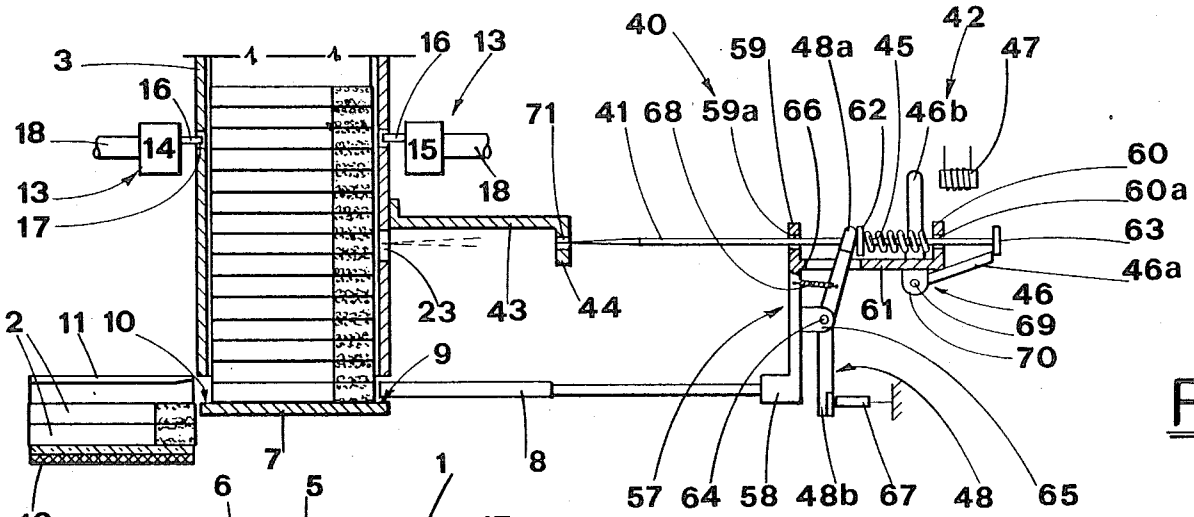
FIGS. 1 and 2 are diagrammatic illustrations of a first embodiment of a feed device constructed in accordance with the present invention in two different operational stages.
Figure 2:
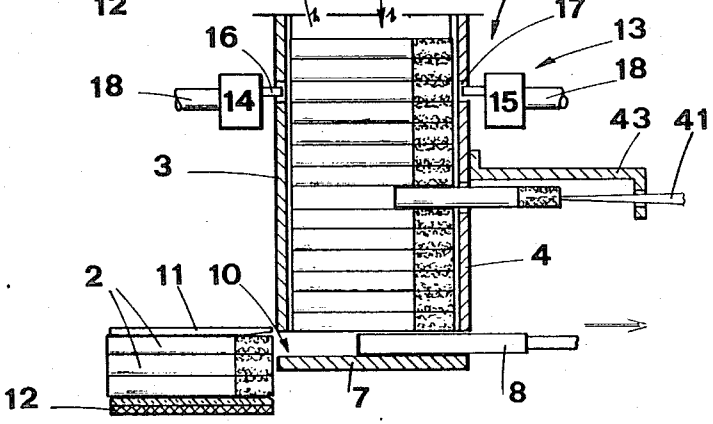

FIGS. 1 and 2 show an inlet hopper 1 of known type for feeding cigarettes 2 to a cigarette packeting machine (not shown). The hopper 1 is defined (for an observer of the FIGURES) by a left-hand wall 3 and a right-hand wall 4, located normal to the major axis of the cigarettes, which are vertical and parallel, and define a compartment having a width which slightly exceeds the length of a cigarette 2. This compartment is divided into a plurality of elementary channels 5 (of which only one is shown) by walls 6 (of which only one is visible in the FIGURES) disposed at a distance apart which slightly exceeds the diameter of the cigarettes 2. The elementary channels 5 are lowerly delimited by a horizontal wall 7 on which the piles of cigarettes 2 contained in the channels 5 rest. Said cigarettes 2 are engageable in groups by a pusher element 8 mobile with reciprocating motion in a horizontal direction normal to the walls 3 and 4 through horizontal slots 9 and 10 provided through the walls 3 and 4 in a position adjacent to the wall 7 and having a height at least equal to the diameter of the cigarettes 2. The pusher element 8 moves from a rest position external to the hopper 1 and shown in the figures, to an operating position within the hopper 1 in order to push the cigarettes 2 from the channels 5 into containers 11 (of which only one is shown) carried by a conveyor belt 12 which is driven with intermittent motion and transfers the groups of cigarettes 2 towards a packeting unit (not shown). During this transfer, an expulsion unit (not shown) expels those groups of cigarettes 2 containing one or more defective cigarettes 2 from the conveyor belt 12.

For a better understanding of the structure of the hopper 1, the channels 5, the pusher element 8, the conveyor belt 12 and said expulsion unit (not shown), reference should be made to the description and drawings of British Pat. No. 1,298,785 and of British Pat. No. 2,023,994 in the name of the present applicant G.D. S.p.A.

Along each channel 5 there is provided a sensor means or device for checking the soundness of the individual cigarettes 2, which is indicated overall by 13 and comprises two opposing sensors or feelers 14 and 15 for the ends of the individual cigarettes 2, each provided with a feeler pin 16 aligned with and opposing the corresponding pin 16 of the other sensor; said pins 16 extend through respective horizontal holes 17 formed in the walls 3 and 4. The pins 16 are elastically mounted on the respective sensors 14 and 15, and move with reciprocating motion through the respective holes 17 under the thrust of reciprocating pusher elements 18 acting synchronously in opposing directions.

A discarding device 40 is provided below the checking device 13 external to the hopper 1 in front of the wall 4 in a so-called extraction position, and operates through a hole 23 provided in the wall 4 at a distance from the position of the pins 16 which is equal to or a multiple of the diameter of a cigarette 2. The checking device 13 is connected to a normally open contact (not shown) which closes should the feeler pins 16 detect a cigarette 2 which is too short or is not sufficiently filled with tobacco at its end. This contact is able, by way of a memory element (not shown), to activate the discarding device 40 in order to remove the defective cigarettes 2 during their pause in alignment with the hole 23.

According to the present invention, the discarding device 40 is an extraction device facing the wall 4 of the hopper 1. Said extraction device 40 (see FIGS. 1 and FIGS. 3 to 6) is provided with means which engage, retain and extract the defective cigarettes 2, and comprise a series of sharp elements in the form of needles 41 (one for each channel 5) which face the holes 23 and are aligned with those cigarettes 2 which at any given time are located in correspondence with the holes 23, and operating means 42 controlled by the checking device 13.

The needles 41 and operating means 42 are supported (see FIG. 1) by a single support element 57 which is secured to the pusher element 8 by a locking member 58.

The support element 57 comprises two walls indicated from left to right by 59 and 60, which are parallel to the wall 4 and are made rigid with each other by means of the horizontal wall 61.

Both the walls 59 and 60 are provided with a series of horizontal holes indicated respectively by **59*a* and 60*a* and slidably traversed by the needles 41**.

On each needle 41 there are mounted two discs 62 and 63, the first of which is intermediate between the walls 59 and 60, and the second of which, known hereinafter as the end disc, is to the right of the wall 60 (for an observer of FIG. 1).

A spring 45 wound on the respective needle 41 and resting against the wall 60 acts against one face of each intermediate disc 62. The second face of each disc 62 is engaged by the free end of an arm **48*a* of a double arm lever 48 which is pivoted at an intermediate point 64 to a pair of support brackets 65 fixed to the wall 59 below the arm 61. The wall 48*a* of the double-arm lever 48 projects upwardly from the wall 61 through a slot 66, and the free end of the second arm 48*b* of the said double-arm lever 48 intercepts a fixed counteracting member 67 in a position in which it opposes the action of the disc 62**.

A tension spring 68 has one end fixed to an intermediate point of the arm **48*a* and its other end fixed to the wall 59. An interception member acts on the inner face of the disc 63 and consists of a second double-arm lever 46 pivoted at an intermediate point 69 to a pair of support brackets 70 fixed to the underside of the wall 61. Said lever 46, of which the free end of one of its arms 46*a* intercepts the disc 63, has its second arm 46*b* extending substantially perpendicular to the first arm 46*a* above the wall 61 through a slot (not shown). An electromagnet 47 controlled by the checking device 13 cooperates with the free end of the arm 46*b* of the double-arm lever 46, and is supported by the pusher element 8 in a manner not shown. When the electromagnet 47 is energized by the checking device 13, it attracts the free end of the arm 46*b* so as to cause the double-arm lever 46 to rotate clockwise, for an observer of FIG. 1, so as to free the disc 63 from the arm 46*a*. The spring 45, the electromagnet 47 and the double-arm levers 46 and 48 thus constitute said operating means 42**.

Means for disengaging the defective cigarettes 2 from the needles 41 are disposed between the wall 59 and the wall 4, and comprise a wall 44 which is supported by a bracket 43 connected to the hopper 1 and is parallel to said wall 4, but spaced apart therefrom by a distance greater than the length of a cigarette 2. The wall 44 is provided with a plurality of passage holes 71 for the needles 41, of smaller diameter than the diameter of a cigarette 2.

When in operation, each of the pins 16 probes a respective cigarette 2 through a hole 17 during the pause stage of each machine cycle, and thus when the cigarettes 2 are at rest within the channels 5. Under normal operating conditions, the needles 41 move, together with the pusher element 8 which supports them, from a first end position (as shown by full lines in FIG. 1), in which they are substantially external to the respective holes 71 of the wall 44, to a second end position (shown by dashed lines in FIG. 1) in which their pointed ends are in positions substantially corresponding with the holes 23 of the wall 4.

When a cigarette 2 is found to be defective, the checking device 13 arranges for it to be discarded by way of said memory device.

As a consequence, when the defective cigarette 2 reaches a position corresponding with the hole 23, the electromagnet 47 is energised and attracts the free end of the arm **46*b* of the double-arm lever 46. As a result of the clockwise rotation of the double-arm lever 46, the second arm 46*a* releases the end disc 63**.

The needle 41, no longer retained by the double-arm lever 46, undergoes under the thrust of the spring 45 a further path of travel towards the wall 4 independently of the pusher element 8. Under these conditions, when the pusher element 8 undergoes its outward stroke for forming a group of cigarettes 2, the said needle 41 moves from a first end position interposed between the walls 44 and 4 to a second end position within the hopper 1.

By attaining this second end position, said needle 41 becomes inserted into the defective cigarette 2. During the next return stroke of the pusher element 8, the needle 41 drags the defective cigarette 2 with it (see FIG. 2) until the cigarette intercepts the wall 44. On conclusion of the return stroke of the pusher element 8, the free end of the arm **48*b* of the double-arm lever 48 intercepts the fixed counteracting member 67. The lever 48 consequently rotates about its pivot 64 in such a manner that its arm 48*a*, brought into contact with the intermediate disc 62, compels the respective needle 41 to undergo a further path of travel against the action of the spring 45. During this further path of travel of the needle 41, this latter disengages from the defective cigarette 2, which is intercepted by the wall 44, and the end disc 63 passes beyond the free end of the arm 46*a* of the double-arm lever 46**.

If the next cigarette 2 is also found to be defective, the electromagnet 47 is again energised and the described cycle is repeated. If however the next cigarette 2 is not found to be defective, the double-arm lever 46 rotates under the action of a return spring (not shown), and the free end of its arm **46*a* again intercepts the end disc 63**.

Figure 3:
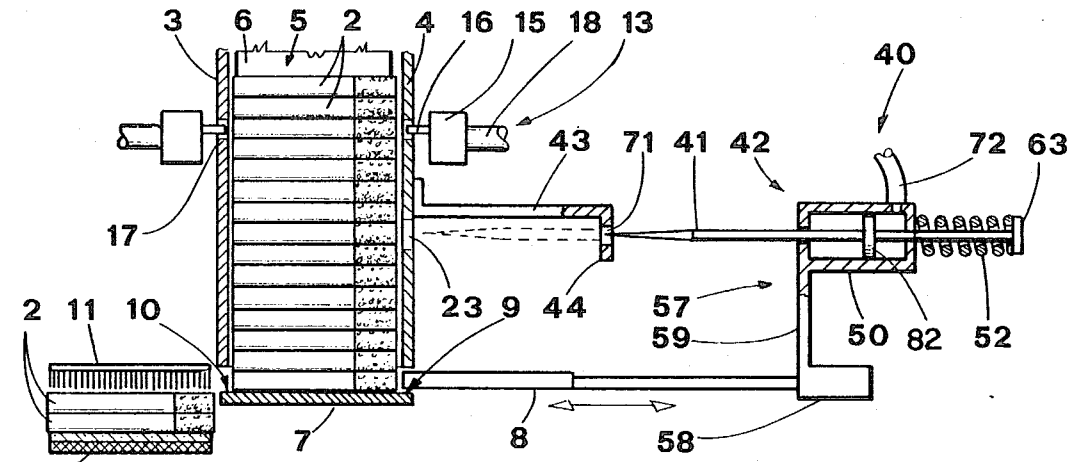
FIGS. 3 to 6 show further embodiments of the feed device of FIG. 1 and 2.

In the embodiment shown in FIG. 3, the operating means 42 consist of a single-acting fluid cylinder 50 and a spring 52.

In this case, the walls 59, 60 and 61 of FIG. 1 form the tube of the fluid cylinder 50, and the intermediate disc 62 of FIG. 1 is replaced by the piston 82 of said cylinder 50. The needle 41 acts as the rod of the piston 82, and also carries a disc 63 at one of its ends. The spring 52 is mounted over the needle 41 between the disc 63 and the tube of the cylinder 50.

In this embodiment, the further travel of the needle 41 within the hopper 1 for extracting a defective cigarette 2 is again induced by the checking device 13, which controls the flow of air or other fluid to the cylinder 50 through a pipe 72. During the return stroke of the pusher element 8, air feed through the pipe 72 is interrupted, and the needle 41, now subjected only to the action of the spring 52 which performs the function of the double-arm lever 48 of FIG. 1, returns to its initial position.

The cylinder 50 can alternatively be double-acting, in which case neither the spring 52 nor the disc 63 are necessary. The needle 41 is then made to undergo its further travel in the one or other direction by feeding air into the one or other chamber of the cylinder 50.

Figure 4:
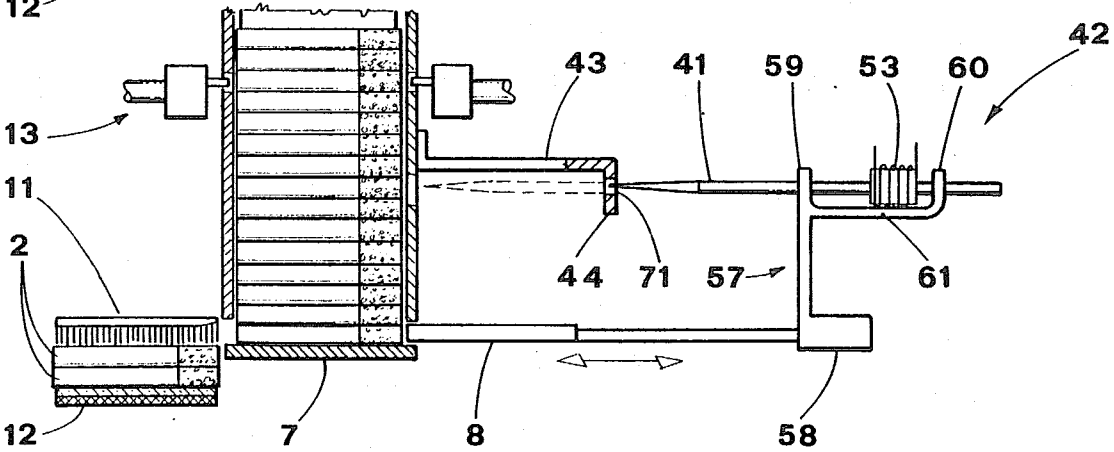

In the embodiment shown in FIG. 4, the operating means 42 consist of an electromagnet 53 supported by a support element 57 equal to that of FIG. 1. The operation of this discarding device 40 is substantially the same as in the case of the device shown in FIG. 3, but for a double-acting fluid cylinder 50.

Figure 5:
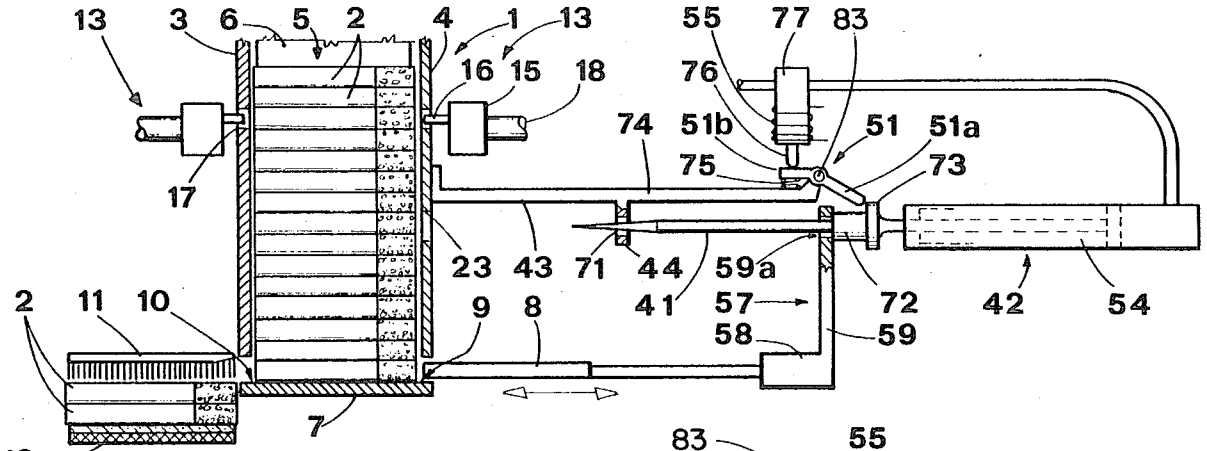

In the embodiment shown in FIG. 5, both the needles 41 and the operating means 42 are supported by elements (not shown) which are fixed with respect to the hopper 1. In this case, the operating means 42 is fixedly located and consist of a fluid cylinder 54 and interception means comprising a double-arm lever 51. Control means consisting of an electromagnet 55 are also provided. The needle 41 acts as the piston rod of the cylinder 54, and freely passes through a hole 59*a* in a support and retention element 57.

Between the retention element 57 and cylinder 54, there is mounted and fixed on the needle 41 a small cylinder 72 from which there projects a collar 73 which, when the feed device is operating normally, (i.e. in the absence of defective cigarettes 2), is intercepted by the free end of an arm 51*a* of the double-arm lever 51, which serves as a restraining means. The double-arm lever 51 is pivoted at an intermediate point 83 to the free end of a horizontal wall 74 rigid with the wall 43 connected to the hopper 1. A compression spring 75 fixed to the wall 74 acts on the underside of the free end of the other arm 51*b*, and the armature 76 of the electromagnet 55 acts on the upper side of said free end. The armature 76 of the electromagnet 55 also acts on a slide valve 77 connected into the air feed pipe to the cylinder 54.

In the absence of defective cigarettes 2, the needle 41 is retained in a retracted end position by the free end of the arm 51*a* which intercepts the collar 73, while the pusher element 8 undergoes its travel strokes by moving regularly relative to the thus retained needle 41. If a defective cigarette 2 is detected, the checking device 13 energises the electromagnet 55 which acts by way of its armature 76 both on the slide valve 77 such that the fluid cylinder 54 urges the needle 41 towards the wall 4 and on the double-arm lever 51 such as to rotate it to cause the free end of the arm 51*a* of said double-arm lever 51 to disengage from the collar 73. In other words, the operating means 42 urges the discording device or needle 41 towards the hoper 1 and into contact with the pusher element 8 upon disengagment of the restraining means 51 from the needle. Upon being freed from the restraining means 51, the needle moves with the pusher element 8 to remove the defective cigarette.

During its next advancement stroke, the pusher element 8 allows the needle 41, urged by the cylinder 54, to advance to a second end position within the hopper 1, in which it penetrates and thus engages the defective cigarette 2.

During its return stroke, the pusher element 8 causes the needle 41 to withdraw until the defective cigarette 2 disengages from the needle 41 and until the collar 73 is again intercepted by the free end of the arm 51*a* of the double-arm lever 51. During this return stroke of the pusher element 8, and following deenergization of the electromagnet 55 by switch means, not shown, the double-arm lever 51 rotates clockwise under the action of the spring 75 such as to bring its arm 51*a* into engagement with the collar 73, and the slide valve 77 shuts-off fluid feed to the cylinder 54.

Figure 6:
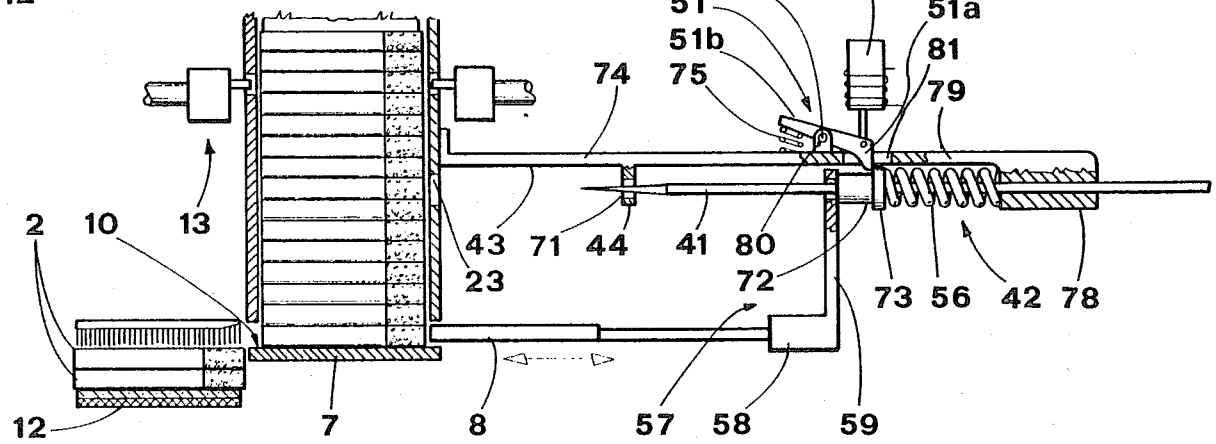

In the embodiment shown in FIG. 6, the needle 41 is supported freely slidable by the support and retention element 57, equal to that of FIG. 5, and by a block 78 supported at its free end by an extension 79 of the wall 74 of FIG. 5.

As in the case of FIG. 5, the needle 41 is again provided with the small cylinder 72 and collar 73, and also carries a compression spring 56 over that portion between the collar 73 and block 78. As in the case of FIG. 5, the collar 73 is again intercepted by the free end of an arm 51*a* of the double-arm lever 51 pivoted at an intermediate point 83 to a pair of support brackets 80 fixed to the upper side of the wall 74. The free end of the arm 51*a* of the double-arm lever 51 projects below the wall 74 through a slot 81.

Between the free end of the second arm 51*b* of the double-arm lever 51 and the wall 74, there is provided a spring 75 which keeps the free end of the arm 51*a* in the position in which it intercepts the collar 73. An electromagnet 55 controlled by the checking device 13 is provided above the arm 51*a* of the double-arm lever 51. If no defective cigarettes 2 are detected, the needles 41 remain at rest in their retracted end position determined by the double-arm lever 51, of which the free end of the arm 51*a* intercepts the collar 73.

If the presence of a defective cigarette is detected, the checking device 13 energises the electromagnet 55, which attracts the arm 51*a* of the double-arm lever 51 against the elastic action of the spring 75. Under these conditions, the spring 56 presses the small cylinder 72 against the wall 59 of the support and retention element 57.

During the next advancement stroke of the pusher element 8, this latter carries with it the needle 41, which advances towards its second end position within the hopper 1, to become inserted into the defective cigarette 2.

During its return stroke, the pusher element 8 withdraws the needle 41 and compresses the spring 51 to bring the collar 73 into engagement with the free end of the arm 51*a* of the double-arm lever 51, as shown in FIG. 6.

The disengagement of the defective cigarette 2 from the needle 41 takes place exactly as described with reference to FIGS. 1 and 2, as it also does in the embodiments illustrated in FIGS. 3, 4 and 5.

With devices of the described type, which use mechanical means for extracting the defective cigarettes 2 from the hopper 1, all the previously stated drawbacks consequent on the use of compressed air for expelling the defective cigarettes are obviated.

Modifications and/or improvements falling within the scope of the following claims are possible in practice.

I claim:

1. A device for feeding cigarettes to the wrapping line of a packeting machine, comprising a horizontal wall (7); a hopper (1) for feeding cigarettes (2) to said machine, said hopper (1) being divided into a plurality of outlet channels (5) each having a width substantially equal to the diameter of a cigarette (2), and through which the cigarettes (2) descend stepwise until they rest on said horizontal wall (7); a pusher element (8) operable between a first rest position and a second eject position, said second eject position, being spaced from said first rest position and within one of said outlet channels for pushing said cigarettes out of said hopper; sensor means (13) provided along at least one of said channels (5) for checking the cigarettes (2) in succession; and at least one discarding device (40) controlled by said sensor means (13) for removing defective cigarettes (2) from said hopper (1), said discarding device (40) being disposed, with respect to said hopper (1), between said sensor means (13) and said pusher element (8) and being provided, for each of said channels (5), with means (41) which engage, retain and extract the defective cigarettes (2) from said hopper (1) and which during extraction of defective cigarettes (2) are operable between a first and a second end position, said second end position being within at least a wall of said hopper (1); said means (41) being secured with said pusher element so as to be movable therewith.

2. The device as claimed in claim 1, characterized in that said means (41) are needle-like, sharp elements.

3. The device as claimed in claim 2, characterised in that said means (41) and said operating means (42) are supported by said pusher element (8) and move therewith; said operating means (42) enabling said means (41) to move beyond said second end position with said pusher element to engage defective cigarettes, said means (41) then being carried back to said first end position by said pusher element to remove from said hopper said defective cigarette (2).

4. The device as claimed in claim 3, characterized in that said operating means (42) comprise, for each of said means (41), an elastic element (45) arranged to cause said means (41) to undergo movement beyond said first end position and toward said second end position; an interception member (46) arranged to retain said means (41) in a retracted position against the action of said elastic element (45); a counteracting member (67) fixed with respect to said pusher element; a double arm level (48) movably attached to said pusher element and having an upper arm (48*a*) and a lower arm (48*b*) attached to said upper arm, said upper arm biasing said means (41) against said elastic element (45), said lower arm abutting said counteracting member (67); a control member (47) controlled by said sensor means (13) and arranged to release said means (41) from said interception member (46) by disengaging said interception member and said upper arm from said means (41), said upper arm returning to act on said means (41) upon reengagement of said means (41) with said interception member in said first end position.

5. The device as claimed in claim 3, characterized in that said operating means (42) consist of one fluid cylinddr (50) for each means (41).

6. The device as claimed in claim 5, further including elastic means (52) attached to said operating means (42) and biasing said means (41) toward said hopper, said device being characterized in that said fluid cylinder (50) is single-acting, urging means (41) toward said hopper (1) against the action of said elastic means (52).

7. The device as claimed in claim 3, characterized in that said operating means (42) consists of a electromagnet (53) mounted on said means (41); said advancement between said first and said second end positions of said means (41) being caused by energizing said electromagnet (53).

8. The device as claimed in claim 2 further comprising elements (43, 44) fixed relative to said hopper and operable with said means (41) to abut a defective cigarette carried by said means (41) and to cause said defective cigarette to slide free of said means (41) during the movement of said means (41) to said first position, said device being characterized in that said means (41) and said operating means (42) are supported by said elements (43); said device further comprising interception means (51) pivotally attached to said elements (43) for movement between an engaged and a disengaged position with respect to said means (41) such that when said interception means (51) is in said disengaged position said means (41) moves together with said pusher element (8) to said second end position within said hopper (1), said pusher element (8) determining the return travel of said means (41) to said first end position and engagement with said interception means (51); control means (55) controlled by said sensor means (13) being provided for pivoting said interception means (51) to said disengaged position upon the sensing of a defective cigarette.

9. The device as claimed in claim 8, characterized in that said operating means (42) comprise, for each of said means (41), a single-acting fluid cylinder (54) and said interception means (51), the activation of said fluid cylinder (54) and the disengagement of said interception means (51) from said means (41) being determined simultaneously by said control means (55).

10. The device as claimed in claim 8, characterized in that said operating means (42) comprise, for each of said means (41), an elastic element (56) arranged to urge said means (41) towards said hopper (1).

11. A device for feeding cigarettes to the wrapping line of a packeting machine comprising:

a hopper for feeding cigarettes to said packeting machine, said hopper having a first and a second side wall located normal to the major axes of the cigarettes, said first wall defining in its surface a first opening and a second opening, said second wall defining in its surface a slot, said slot being located opposite said second opening;

a plurality of outlet channels defined between said first and said second walls and normal thereto, said channels acting to receive said cigarettes as they move through said hopper;

a wall disposed at the end of said outlet channels and parallel therewith, said wall serving to support said cigarettes as they pass through said hopper, said wall being proximate to said second opening and said slot;

a pusher element aligned with said slot and said second opening and operable between a first rest position and a second push position wherein said pusher element slides through said second opening when moving from said first rest position to said second push position and thereby pushes a cigarette out of said slot and then returns to said first rest position;

sensor means located along at least one outlet channel for checking the cigarettes before they encounter said pusher element;

a discarding device aligned with said first opening and associated with said sensor means for removing from said hopper through said first opening a defective cigarette before its encounter with said pusher element, said discarding device moving with said pusher element upon detection of a defective cigarette by said sensor means;

a fixed wall connected to said hopper and aligned with said first opening, said fixed wall being spaced from said first opening a length greater than that of said cigarette, said wall cooperating with said discarding device to cause any defective cigarette carried upon said discarding device to fall freely therefrom;

retraining means associated with said sensor and fixedly attached with respect to said hopper, said restraining means restraining said discarding device from movement with said pusher element;

a fixedly located operating means associated with said sensor means, said operating means being operable to urge said discarding device toward said hopper and into contact with said pusher element upon disengagement of said restraining means from said discarding device, said restraining means being moved to a disengaged position upon activiation of said sensor means, whereby upon said sensing means sensing a defective cigarette said discarding device is freed from said restraining means to move with said pusher element and remove the defective cigarette.

12. The device according to claim 11 wherein said operating means is a pneumatic device.

13. The device according to claim 11 wherein said operating means is a hydraulic device.

14. The device according to claim 11 wherein said operating means is comprised of a spring and a fixed support member, said spring being located between said discarding device and said fixed support member to bias said discarding device against said restraining means.

15. The device according to claim 11 wherein upon extraction of said cigarette by said discarding device said pusher element carries said discarding device back to its original position where it is again retained by said restraining means.

16. The device according to claim 11 wherein said discarding device is a needle.

* * * * *